US006650850B2

(12) United States Patent
Nishimura

(10) Patent No.: US 6,650,850 B2
(45) Date of Patent: Nov. 18, 2003

(54) APPARATUS AND METHOD FOR CLEANING RESIDUAL TONER FROM AN IMAGE BEARING MEMBER

(75) Inventor: Soichiro Nishimura, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 37 days.

(21) Appl. No.: 10/103,714

(22) Filed: Mar. 25, 2002

(65) Prior Publication Data

US 2002/0141771 A1 Oct. 3, 2002

(30) Foreign Application Priority Data

Mar. 28, 2001 (JP) ..... 2001-091819

(51) Int. Cl.[7] ..... G03G 15/02; G03G 21/00; G03G 15/30

(52) U.S. Cl. ..... 399/50; 399/71; 399/149

(58) Field of Search ..... 399/50, 66, 71, 399/149, 357

(56) References Cited

U.S. PATENT DOCUMENTS 5,765,076 A * 6/1998 Ogata et al. ..... 399/149 X
5,822,657 A * 10/1998 Hisada et al. ..... 399/149
5,832,336 A * 11/1998 Kawasaki et al. ..... 399/71
5,970,302 A * 10/1999 Yamane ..... 399/50 X
5,974,277 A * 10/1999 Yamane et al. ..... 399/50
6,081,679 A * 6/2000 Yamane et al. ..... 399/71
6,173,135 B1 * 1/2001 Yuminamochi et al. ..... 399/66
6,205,299 B1 * 3/2001 Kusaka et al. ..... 399/66 X

* cited by examiner

*Primary Examiner*—Fred L. Braun
(74) *Attorney, Agent, or Firm*—Oliff & Berridge, PLC

(57) ABSTRACT

An apparatus and method for removing residual toner from a photosensitive drum wherein a first cleaning bias (600 V) is applied to a cleaning roller, a bias applied to a transfer roller is switched between a second transfer bias and a first transfer bias. The surface potential of a photosensitive drum changes depending on the bias applied to the transfer roller. When the photosensitive drum contacts the transfer roller while the second transfer bias is applied to the transfer roller, the surface potential of the photosensitive drum becomes the second surface potential (approximately 900–1000 V). When the photosensitive drum having the second surface potential contacts the cleaning roller, the cleaning roller collects toner remaining on the photosensitive drum. When the photosensitive drum contacts the transfer roller while the first transfer bias is applied to the transfer roller, the surface potential of the photosensitive drum becomes the first surface potential (approximately 200–400 V). When the photosensitive drum having the first surface potential contacts the cleaning roller, the cleaning roller releases the collected toner to the photosensitive drum.

21 Claims, 4 Drawing Sheets

APPARATUS AND METHOD FOR CLEANING RESIDUAL TONER FROM AN IMAGE BEARING MEMBER

BACKGROUND OF THE INVENTION

1. Field of Invention

The invention relates to an electrophotographic image forming apparatus, such as a laser printer.

2. Description of Related Art

Eelectrophotographic image forming apparatus are well known in the art. These devices, such as a laser printer, typically includes a photosensitive drum, a charger, a laser scanner, a developing roller, and a transfer roller. After the surface of the photosensitive drum is uniformly charged by the charger, the surface of the photosensitive drum is irradiated with a laser beam emitted from the laser scanner, and an electrostatic latent image is formed based on predetermined image data.

Toner carried on the developing roller is supplied to the electrostatic latent image formed on the surface of the photosensitive drum. The toner deposited on the surface of the photosensitive drum is transferred to a sheet passing between the photosensitive drum and the transfer roller.

Although most of the toner deposited on the photosensitive drum is transferred to the sheet, part of the toner remains on the photosensitive drum. The remaining toner is collected by the developing roller and recycled.

However, when a large amount of toner remains on the photosensitive drum and is not thoroughly collected by the developing roller, the remaining toner adversely affects the next image to be formed on the photosensitive drum, causing a deterioration in print quality.

SUMMARY OF THE INVENTION

The invention provides an image forming apparatus that is simply structured at a low cost and can reliably remove developing agent remaining on an image bearing member.

According to one exemplary aspect of the invention described herein, a bias is applied to a cleaning member so that the cleaning member is kept at a fixed potential, and a potential of an image bearing member that contacts the cleaning member is selectively changed between a first potential and a second potential. The bias applied to the cleaning member is higher than the first potential and lower than the second potential.

When the image bearing member is at the first potential, developing agent remaining on the image bearing member is collected by the cleaning member due to a potential difference between the image bearing member and the cleaning member.

When the image bearing member is at the second potential, the developing agent collected by the cleaning member returns to the image bearing member due to a potential difference between the image bearing member and the cleaning member.

In order to change the potential of the image bearing member between the first potential and the second potential, a bias applied to a transfer member is switched between a first transfer bias and a second transfer bias. When the first transfer bias is applied to the transfer member, the image bearing member bears the first potential. When the second transfer bias is applied to the transfer member, the image bearing member bears the second potential. A selector switch is provided to switch between a first transfer power source for outputting the first transfer bias and a second transfer power source for outputting the second transfer bias.

By changing the potential of the image bearing member, which is accomplished by a simple low-cost structure, cleaning of the transfer member and cleaning of the cleaning member can be performed concurrently.

BRIEF DESCRIPTION OF THE DRAWINGS

The invention will be described with reference to the accompanying drawings, in which like elements are labeled with like numbers and in which.

DETAILED DESCRIPTION OF PREFERRED EMBODIMENTS

Figure 1:
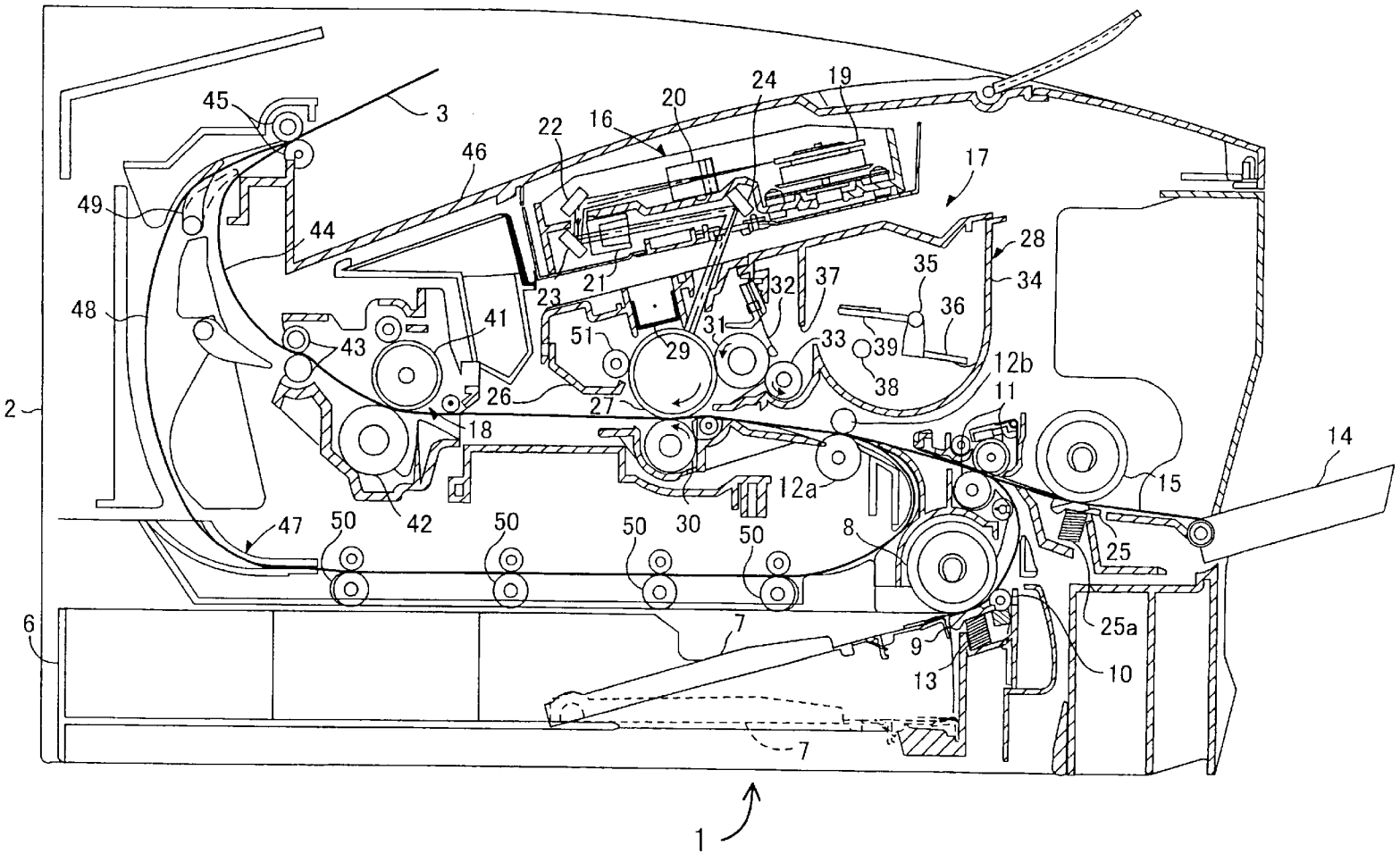
FIG. 1 is a side sectional view of the substantial parts of a laser printer according to one embodiment of this invention.

FIG. 1 is a side sectional view of the substantial parts of a laser printer 1. A sheet feed tray 6 is detachably attached to a bottom portion of a casing 2. A presser plate 7 is provided in the sheet feed tray 6 so as to support and upwardly press sheets 3 stacked in the sheet feed tray 6. A sheet feed roller 8 and a sheet feed pad 9 are provided above one end of the sheet feed tray 6, and conveying rollers 11 are provided downstream from the pickup sheet feed roller 8 with respect to the sheet conveying direction. Resistor rollers 12*a*, 12*b* are provided further downstream from the conveying rollers 11 with respect to the sheet conveying direction.

The presser plate 7 allows sheets 3 to be stacked thereon. The presser plate 7 is pivotally supported at its end remote from the sheet feed roller 8 such that the presser plate 7 is vertically movable at its end closer to the sheet feed roller 8. The presser plate 7 is urged upwardly from its reverse side by a spring (not shown). When the stack of sheets 3 is increased in quantity, the presser plate 7 swings downwardly about its end remote from the sheet feed roller 8, against the urging force from the spring. The sheet feed roller 8 and the sheet feed pad 9 are disposed facing each other. The sheet feed pad 9 is urged toward the sheet feed roller 8 by a spring 13 disposed on the reverse side of the sheet feed pad 9.

An uppermost sheet 3 in the stack on the presser plate 7 is pressed against the sheet feed roller 8 by the spring provided on the reverse side of the presser plate 7, and the uppermost sheet 3 is pinched between the sheet feed roller 8 and the sheet feed pad 9 when the sheet feed roller 8 rotates. Thus, sheets 3 are fed one by one from the top.

A paper dust removing roller 10 is provided downstream from the sheet feed roller 8 with respect to the sheet conveying direction. When a sheet 3 fed by the sheet feed roller 8 contacts the paper dust removing roller 10, paper dust on the surface of the sheet 3 is partially removed.

After paper dust is removed from the sheet 3 by the paper dust removing roller 10, the sheet 3 is conveyed by conveying rollers 11 to the resistor rollers 12*a*, 12*b*. The resistor rollers 12*a*, 12*b* are made up of two rollers, that is, a driving roller 12*a* provided for the casing 2 and a driven roller 12*b* provided for a process unit 17, which will be described later.

The driving roller 12*a* and the driven roller 12*b* make a surface-to-surface contact with each other. The sheet 3 conveyed by the conveying rollers 11 is further conveyed downstream while being pinched between the driving roller 12*a* and the driven roller 12*b*.

The driving roller 12*a* is not driven before the sheet 3 makes contact with the driving roller 12*a*. After the sheet 3 makes contact with the driving roller 12*a* and the driving roller 12*a* corrects the orientation of the sheet 3, the driving roller 12*a* rotates and conveys the sheet 3 downstream.

A manual feed tray 14 from which sheets 3 are manually fed and a manual feed roller 15 that feeds sheets 3 stacked on the manual feed tray 14 are provided at the front of the casing 2. A separation pad 25 is disposed facing the manual feed roller 15. The separation pad 25 is urged toward the manual feed roller 15 by a spring 25*a* disposed on the reverse side of the separation pad 25. The sheets 3 stacked on the manual feed plate 14 are fed one by one while being pinched by the manual feed roller 15 and the separation pad 25 when the manual feed roller 15 rotates.

The casing 2 further includes a scanner unit 16, a process unit 17, and a fixing unit 18.

The scanner unit 16 is provided in an upper portion of the casing 2 and has a laser emitting portion (not shown), a rotatable polygonal mirror 19, lenses 20, 21, and reflecting mirrors 22, 23, 24. A laser beam emitted from the laser emitting portion is modulated based on predetermined image data. The laser beam sequentially passes through or reflects from the optical elements, that is, the polygonal mirror 19, the lens 20, the reflecting mirrors 22, 23, the lens 21, and the reflecting mirror 24 in the order indicated by a broken line in FIG. 1. The laser beam is thus directed to and scanned at a high speed over the surface of a photosensitive drum 27, which will be described later.

Figure 2:
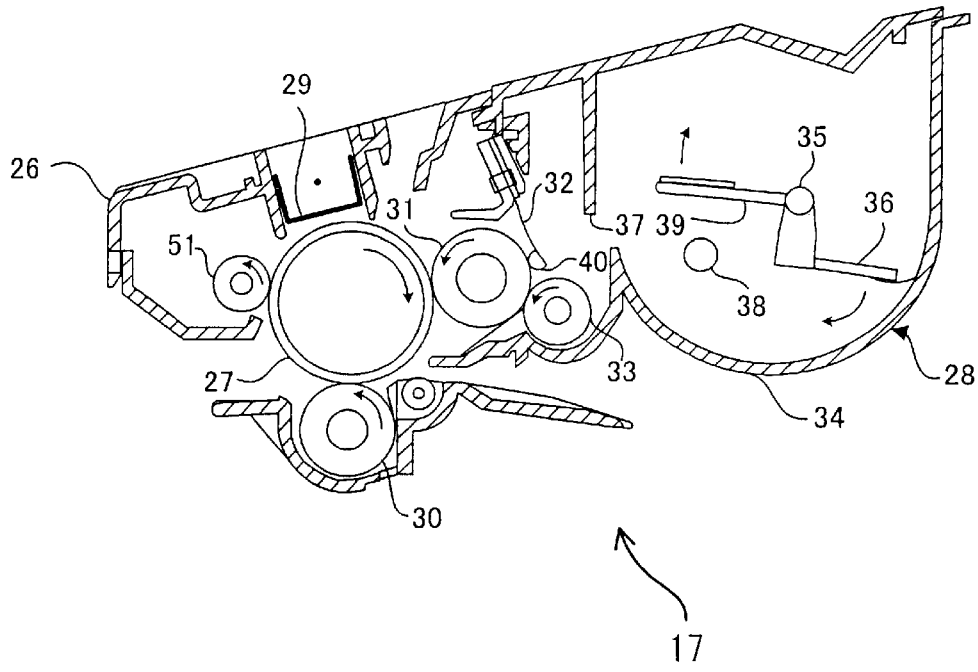
FIG. 2 is a side sectional view of the substantial parts of a process unit of the laser printer of FIG. 1.

FIG. 2 is an enlarged sectional view of the process unit 17. As shown in FIG. 2, the process unit 17 is disposed below the scanner unit 16 and has a drum cartridge 26 detachably attached to the casing 2 and a developing cartridge 28 detachably attached to the drum cartridge 26. The drum cartridge 26 includes the photosensitive drum 27, a scorotron charger 29, and a transfer roller 30. The developing cartridge 28 includes a developing roller 31, a blade 32, a supply roller 33, and a toner box 34.

The toner box 34 contains positively charged nonmagnetic single-component toner, as a developing agent. The toner used in this embodiment is a polymerized toner obtained through copolymerization of styrene-based monomers, such as styrene, and acryl-based monomers, such as acrylic acid, alkyl (C1–C4) acrylate, alkyl (C1–C4) methacrylate, using a known polymerization method, such as suspension polymerization. The particle shape of such a polymerized toner is spherical, and thus the polymerized toner has excellent flowability.

A coloring agent, such as carbon black, and wax is added to the polymerized toner. An external additive, such as silica, is also added to the polymerized toner to improve flowability. The particle size of the polymerized toner is approximately 6–10 $\mu$m.

The toner in the toner box 34 is stirred by an agitator 36 supported by a rotating shaft 35 provided at a central portion of the toner box 34, and is discharged from a toner supply port 37 opened on one side of the toner box 34. A toner detection window 38 is provided on a sidewall of the toner box 34. The toner detection window 38 is wiped clean by a cleaner 39 supported by the rotating shaft 35.

A supply roller 33 is rotatably disposed adjacent to the toner supply port 37. A developing roller 31 is rotatably disposed facing the supply roller 33. The supply roller 33 is formed by covering a metallic roller shaft with an electrically conductive foam material. The developing roller 31 is formed by covering a metallic roller shaft with an electrically conductive rubber material. More specifically, the developing roller 31 is covered with an electrically conductive urethane or silicone rubber containing fine carbon particles, and topcoated with a urethane or silicone rubber containing fluorine. The supply roller 33 and the developing roller 31 are disposed in contact with each other so that they are press-deformed against each other to an appropriate extent. A predetermined developing bias is applied, by a power source 53 shown in FIG. 3, to a shaft 31*a* of the developing roller 31 with respect to the photosensitive drum 27.

A layer thickness-regulating blade 32 is disposed near the developing roller 31 to regulate the thickness of a toner layer formed on the surface of the developing roller 31. The layer thickness-regulating blade 32 has a metallic plate spring and a presser portion 40, which is disposed on a distal end of the plate spring and formed from an electrically insulative silicone rubber into a semicircular shape in section. The plate spring is supported, at its end opposite to its distal end, by a developing cartridge 28 so as to be close to the developing roller 31. The presser portion 40 is pressed against the developing roller 31 by an elastic force of the plate spring.

Toner discharged by the agitator 36 from the toner supply port 37 is supplied to the developing roller 31 when the supply roller 33 rotates. Toner is positively charged between the supply roller 33 and the developing roller 31 due to friction. When the developing roller 31 rotates, toner supplied to the developing roller 31 enters between the presser portion 40 of the blade 32 and the developing roller 31 and are fully charged therebetween. After passing between the presser portion 40 and the developing roller 31, toner is formed into a thin layer of a predetermined thickness on the developing roller 31.

The photosensitive drum 27 is rotatably disposed adjacent to a drum cartridge 26 so as to face the developing roller 31 while leaving a predetermined interval. The photosensitive drum 27 is formed by coating a grounded cylindrical aluminum drum with a positively charged photosensitive layer made of polycarbonate.

The charger 29 is disposed at a predetermined interval upward from the photosensitive drum 27. The charger 29 is a scorotron charger that produces corona discharge from a tungsten wire and positively charges the surface of the photosensitive drum 27 uniformly. The charger 29 is designed to charge the surface of the photosensitive drum 27 to a potential of approximately 900 V. The charger 29 is turned on and off by a power source 52 shown in FIG. 3.

The surface of the photosensitive drum 27 is uniformly positively charged by the charger 29. The surface potential of the photosensitive drum 27 is approximately 900 V. When the surface of the photosensitive drum 27 is irradiated with a laser beam emitted from the scanner unit 16, electric charge is removed from a portion exposed to the laser beam, and the surface potential of the exposed portion becomes approximately 200V. In this way, the surface of the photosensitive drum 27 is divided into a high-potential portion (unexposed portion) and a low-potential portion (exposed portion), and thereby an electrostatic latent image is formed.

The surface potential of the unexposed portion is approximately 900 V, while the surface potential of the exposed portion is approximately 200 V.

When positively charged toner on the developing roller 31 faces the photosensitive drum 27, the toner is supplied to the low-potential exposed portion of the photosensitive drum 27. As a result, an electric latent image formed on the photosensitive drum 27 is visualized.

Figure 3:
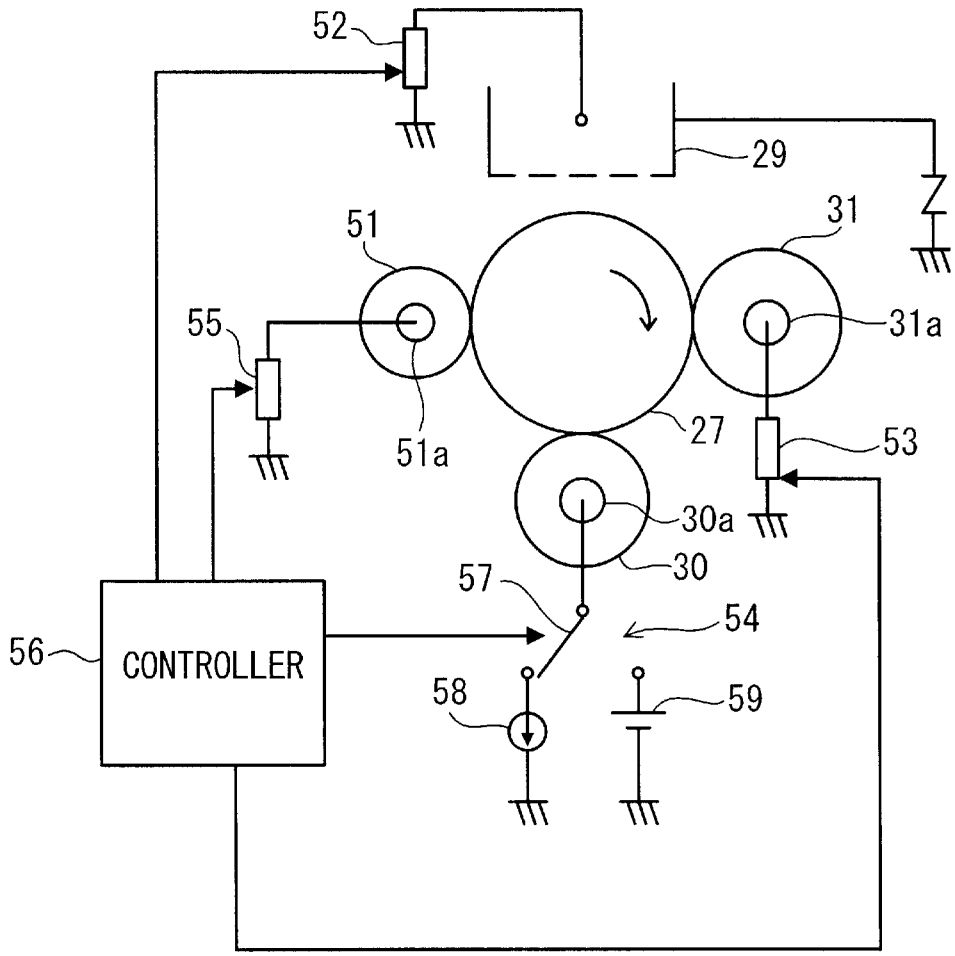
FIG. 3 is a block diagram showing the structure of power sources for the process unit of FIG. 2.

The transfer roller 30 is disposed below the photosensitive drum 27 to face the photosensitive drum 27, and is rotatably supported by the drum cartridge 26. The transfer roller 30 is formed by covering a metallic roller shaft with a rubber material of ionic conductive type. A power source 54 is connected to a shaft 30*a* of the transfer roller 30, as shown in FIG. 3, and applies a predetermined bias to the roller shaft when toner is transferred to the sheet 3.

When the sheet 3 is conveyed between the photosensitive drum 27 and the transfer roller 30, toner is transferred from the photosensitive drum 27 to the surface of the sheet 3.

As shown in FIG. 1, the fixing unit 18 is disposed downstream from the process unit 17 and has a heat roller 41, a pressure roller 42 pressed against the heat roller 41, and a pair of conveying rollers 43 provided downstream from the heat roller 41 and the pressure roller 42. The heat roller 41 is formed by an aluminum tube coated with a silicone rubber and a halogen lamp placed in the tube. Heat generated from the halogen lamp is transferred to the sheet 3 through the aluminum tube. The pressure roller 42 is made of a silicone rubber, which allows the sheet 3 to be easily removed from the heat roller 41 and the pressure roller 42.

The toner transferred to the sheet 3 by the process unit 17 melts and becomes fixed onto the sheet 3 due to heat, while the sheet 3 is passing between the heat roller 41 and the pressure roller 42. After the fixation is completed, the sheet 3 is conveyed downstream by the conveying rollers 43. An ejecting guide 44 is formed downstream from the conveying rollers 43 to reverse the sheet conveying direction and guide the sheet 3 to an output tray 46 provided on the top surface of the laser printer 1. A pair of ejecting rollers 45 are provided at the upper end of the ejecting guide 44 to eject the sheet 3 to the output tray 46.

The laser printer 1 is provided with a reverse conveying unit 47 that allows image forming on the both sides of the sheet 3. The reverse conveying unit 47 includes ejecting rollers 45, a reverse conveying path 48, a flapper 49, and a plurality of pairs of reverse conveying rollers 50. A pair of ejecting rollers 45 can be switched between forward and reverse rotation. The ejecting rollers 45 rotate forward to eject the sheet 3 to the output tray 46, and rotate in reverse to reverse the sheet conveying direction.

The reverse conveying path 48 is vertically provided to guide the sheet 3 from the ejecting rollers 45 to the reverse conveying rollers 50 disposed above the sheet feed tray 6. The upstream end of the reverse conveying path 48 is located near the ejecting rollers 45, and the downstream end of the reverse conveying path 48 is located near the reverse conveying rollers 50.

The flapper 49 is swingably provided adjacent to a point branching into the ejecting path 44 and the reverse conveying path 48. The flapper 49 can be shifted between a first position shown by a solid line and a second position shown by a broken line. The flapper 49 is shifted by switching the excited state of a solenoid (not shown).

When the flapper 49 is at the first position, the sheet 3 guided along the ejecting path 44 is ejected by the ejecting rollers 45 to the output tray 46. When the flapper 49 is at the second position, the sheet 3 is conveyed to the reverse conveying path 48 by the ejecting rollers 45 rotating in reverse.

A plurality of pairs of reverse conveying rollers 50 are provided above the sheet feed tray 6 in a substantially horizontal direction. A pair of reverse conveying rollers 50 on the most upstream side are located near the lower end of the reverse conveying path 48. A pair of reverse conveying rollers 50 on the most downstream side are located below the resistor rollers 12*a*, 12*b*.

The operation of the reverse conveying unit 47 when an image is formed on the both sides of the sheet 3 will be described. The sheet 3 with a printed image on one side thereof is conveyed by the conveying rollers 43 along the ejecting path 44 toward the ejecting rollers 45. At this time, the flapper 49 is located at the first position. The ejecting rollers 45 rotate forward while pinching the sheet 3 to convey the sheet 3 temporarily toward the output tray 46. The ejecting rollers 45 stop rotating forward when the sheet 3 is almost ejected to the output tray 46 and the trailing edge of the sheet 3 is pinched by the ejecting rollers 45. In this state, the flapper 49 is shifted to the second position, and the ejecting rollers 45 rotates in reverse. The sheet 3 is conveyed in the reverse direction along the reverse conveying path 48. After the entire sheet 3 is conveyed to the reverse conveying path 48, the flapper 49 is shifted to the first position.

After the above actions have occurred, the sheet 3 is conveyed to the reverse conveying rollers 50, and conveyed upward by the reverse conveying rollers 50 to the resistor rollers 12*a*, 12*b*. The sheet 3 is then conveyed to the process unit 17 with its printed side facing down. As a result, an image is printed on both sides of the sheet 3.

The developing roller 31 collects the toner remaining on the surface of the photosensitive drum 27. The remaining toner is the toner that has been supplied to the photosensitive drum 27 but not transferred from the photosensitive drum 27 to the sheet 3. The remaining toner adheres to the developing roller 31 by a Coulomb force generated due to a potential difference between the photosensitive drum 27 and the developing roller 31, and is collected into the developing cartridge 28. With this method, a scraper that scrapes the remaining toner from the photosensitive drum 27 and a storage place for the scraped toner are not required. Thus, a laser printer can be simplified in structure and made compact, and the manufacturing cost thereof can be reduced.

As shown in FIG. 2, a cleaning roller 51 is provided in the drum cartridge 26.

The cleaning roller 51 is disposed, downstream from the transfer roller 30 with respect to the rotation direction of the photosensitive drum 27 and upstream from the scorotron charger 29, so as to contact the photosensitive drum 27, and is supported by the drum cartridge 26 rotatably in the direction of the arrow.

The cleaning roller 51 is formed by covering a metallic roller shaft with an electrically conductive rubber material. A silicone rubber, a urethane rubber, or EPDM (ethylene-propylene terpolymer) is used as the rubber material.

A first cleaning bias and a second cleaning bias are selectively applied to a shaft 51*a* of the cleaning roller 51 by a power source 55 shown in FIG. 3.

Figure 4:
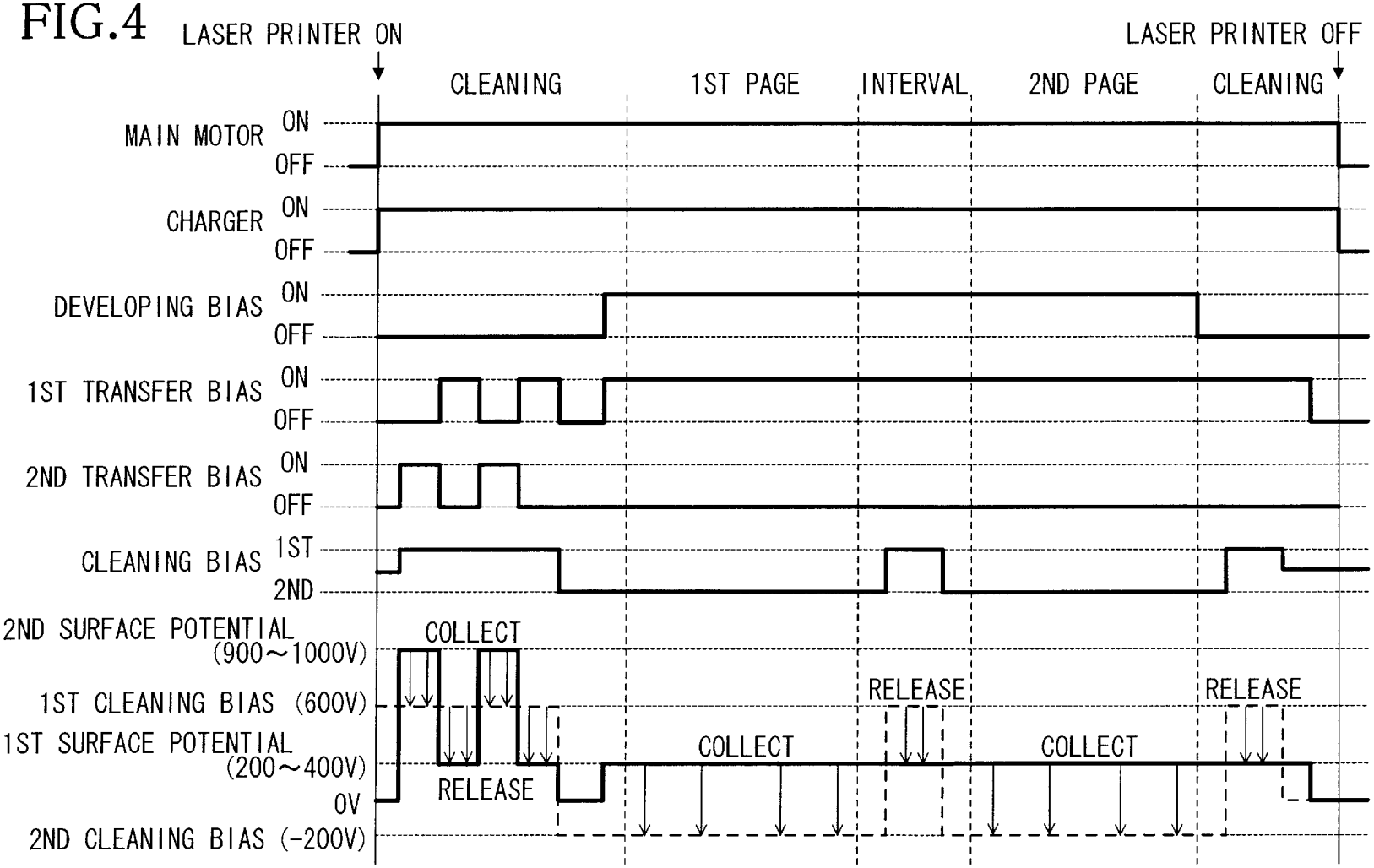
FIG. 4 is a timing chart illustrating electrical toner collection and release by a cleaning roller.

FIG. 3 is a block diagram showing the structure of power sources for the process unit 17. FIG. 4 is a timing chart illustrating electrical toner collection and release by the cleaning roller 51.

In the process unit 17, as described above, the charger 29, the developing roller 31, the transfer roller 30, and the cleaning roller 51 are disposed around the photosensitive drum 27 in this order, in the rotation direction of the photosensitive drum 27.

A power source 52 is connected to the charger 29. A power source 53 is connected to the developing roller 31. A power source 54 is connected to the transfer roller 30. A power source 55 is connected to the cleaning roller 51. Each of the power sources 52, 53, 54, 55 is connected to a controller 56, and voltage and current outputted from each of the power sources 52, 53, 54, 55 are controlled by the controller 56.

The power source 52 connected to the charger 29 is turned on and off by the controller 56. When the power source 52 is turned on, the charger 29 charges the photosensitive drum 27 such that its surface potential becomes approximately 900 V.

The power source 53 connected to the shaft 31*a* of the developing roller 31 is turned on and off by the controller 56. When the power source 53 is turned on, a developing bias is applied to the developing roller 31.

The power source 54 for applying a transfer bias to the transfer roller 30 includes a selector switch 57, a constant-current power source 58, and a constant-voltage power source 59. The selector switch 57 is connected to the shaft 30*a* of the transfer roller 30 while selectively connecting the constant-current power source 58 and the constant-voltage power source 59. The constant-current power source 58 outputs a constant-current bias by a well-known constant-current control method. The constant-voltage power source 59 outputs a constant-voltage bias by a well-known constant-voltage control method.

Under the control of the controller 56, the selector switch 57 selectively switches the power source to be connected to the transfer roller 30 between the constant-current power source 58 and the constant-voltage power source 59. By such selective switching, a transfer bias to be applied to the transfer roller 30 is selectively switched between a first transfer bias outputted from the constant-current power source 58 and a second transfer bias outputted from the constant-voltage power source 59.

The first transfer bias is a constant-current bias outputted from the constant-current power source 58 and, if applied to the transfer roller 30, the surface potential of the transfer roller 30 becomes lower than the surface potential of the photosensitive drum 27 that is about to contact the transfer roller 30. When the first transfer bias is applied to the transfer roller 30, a toner image formed on the photosensitive drum 27 is reliably transferred to a sheet 3 passing between the photosensitive drum 27 and the transfer roller 30.

The first transfer bias is set to be a constant-current of −12 $\mu$A. When the surface potential of the photosensitive drum 27 that is about to contact the transfer roller 30 is approximately 900 V, the surface potential of the photosensitive drum 27 becomes approximately 200–400 V after the photosensitive drum 27 contacts the transfer roller 30 to which the first transfer bias is applied. Hereinafter, the surface potential of the photosensitive drum 27 ranging from approximately 200 to 400V is called a first surface potential.

The second transfer bias is a constant-voltage bias outputted from the constant-voltage power source 59 and, if applied to the transfer roller 30, the surface potential of the transfer roller 30 becomes higher than the surface potential of the photosensitive drum 27 that is about to contact the transfer roller 30. When the second transfer bias is applied to the transfer roller 30, toner deposited on the transfer roller 30 moves to the photosensitive drum 27.

The second transfer bias is set to be a constant-voltage of 1.6 kV. When the surface potential of the photosensitive drum 27 that is about to contact the transfer roller 30 is approximately 900 V, the surface potential of the photosensitive drum 27 becomes approximately 900–1000 V after the photosensitive drum 27 contacts the transfer roller 30 to which the second transfer bias is applied. Hereinafter, the surface potential of the photosensitive drum 27 ranging from approximately 900 to 1000 V is called a second surface potential.

The power source 55 connected to the shaft 51*a* of the cleaning roller 51 is controlled by the controller 56 such that a cleaning bias to be applied to the cleaning roller 51 is selectively switched between a second cleaning bias and a first cleaning bias.

The second cleaning bias is a bias applied to the cleaning roller 51 so that the cleaning roller 51 collects toner remaining on the photosensitive drum 27 when the first transfer bias is ON and toner is transferred from the photosensitive drum 27 to a sheet 3. The second cleaning bias is set at −200 V, which is lower than the first surface potential (approximately 200–400 V).

The first cleaning bias is a bias applied to the cleaning roller 51 so that the cleaning roller 51 releases toner temporarily held thereon to the photosensitive drum 27 when the first transfer bias is ON and no sheet 3 is present between the photosensitive drum 27 and the transfer roller 30. The first cleaning bias is set at 600 V, which is higher than the first surface potential (approximately 200–400 V).

Referring now to FIG. 4, cleaning of the cleaning roller 51 and the transfer roller 30 performed before image forming, and collection of toner by the cleaning roller 51 during image forming will be described.

When the laser printer 1 is turned on, cleaning is performed before image forming to remove toner collected by and remaining on the cleaning roller 51 as well as toner deposited on the transfer roller 30.

When the laser printer 1 is turned on, a main motor for the photosensitive drum 27 and the charger 29 are turned on. Upon application of the second transfer bias to the transfer roller 30, the first cleaning bias (600V) is applied to the cleaning roller 51.

The surface of the photosensitive drum 27 is charged to approximately 900 V by the charger 29 and contacts the transfer roller 30. Because the second transfer bias (1.6 kV) is higher than the surface potential of the photosensitive drum 27 that is about to contact the transfer roller 30, toner deposited on the transfer roller 30 moves to the photosensitive drum 27. As a result, cleaning of the transfer roller 30 is performed. The surface potential of the photosensitive drum 27 that has contacted the transfer roller 30 becomes the second surface potential (approximately 900–1000 V).

When the surface of the photosensitive drum 27 that has contacted the transfer roller 30 contacts the cleaning roller 51, the surface potential (approximately 900–1000 V) of the photosensitive drum 27 that is about to contact the cleaning roller 51 is higher than the first cleaning bias (600V ). Thus, toner on the photosensitive drum 27 is collected by the cleaning roller 51 and temporarily held on the cleaning roller 51.

The transfer bias applied to the transfer roller 30 is switched from the second transfer bias (1.6 kV) to the first transfer bias (−12$\mu$A) while the first cleaning transfer bias (600 V) is applied to the cleaning roller 51. When the surface of the photosensitive drum 27, charged to approximately 900 V by the charger, contacts the transfer roller 30, the surface potential of the photosensitive drum 27 becomes the first surface potential (approximately 200–400 V).

When the surface of the photosensitive drum 27 that has contacted the transfer roller 30 contacts the cleaning roller 51, the surface potential (approximately 200–400 V) of the photosensitive drum 27 that is about to contact the cleaning roller 51 is lower than the first cleaning bias (600V ). Thus, the toner temporarily held on the cleaning roller 51 is released to the surface of the photosensitive drum 27. As a result, cleaning of the cleaning roller 51 is performed.

When the transfer bias applied to the transfer roller 30 is switched from the first transfer bias to the second transfer bias while the first cleaning transfer bias is applied to the cleaning roller 51, toner deposited on the transfer roller 30 moves to the photosensitive drum 27, as already described, and the toner that has moved is collected by the cleaning roller 51.

When the transfer bias applied to the transfer roller 30 is switched from the second transfer bias to the first transfer bias while the first cleaning transfer bias is applied to the cleaning roller 51, and when the photosensitive drum 27 contacts the transfer roller 30, the surface potential of the photosensitive drum 27 becomes approximately 200–400 V, as already described, and the toner held on the cleaning roller 51 is released to the surface of the photosensitive drum 27. In this way, cleaning of the transfer roller 30 and the cleaning roller 51 is performed twice.

The toner released from the cleaning roller 51 to the photosensitive drum 27 is charged by the charger 29 and then collected by the developing roller 31.

As described above, cleaning of the cleaning roller 51 and the transfer roller 30 is performed by fixing the cleaning bias applied to the cleaning roller 51 at the first cleaning bias and by switching the transfer bias applied to the transfer roller 30 between the first transfer bias and the second transfer bias.

In other words, because the surface potential of the photosensitive drum 27 is changed by switching the transfer bias applied to the transfer roller 30, toner is collected by or released from the cleaning roller 51 while the cleaning bias applied to the cleaning roller 51 is fixed. Accordingly, application of the transfer bias and the cleaning bias is easy to control and the cost of the controller 56 can be reduced. In addition, cleaning of the cleaning roller 51 is reliably performed.

Under the above-described control, cleaning of the cleaning roller 51 and cleaning of the transfer roller 30 are performed concurrently. Toner released from the transfer roller 30 is collected by the cleaning roller, and the collected toner is released to the photosensitive drum 27.

In contrast, if cleaning of the cleaning roller 51 and cleaning of the transfer roller 30 are separately performed before image forming, the time required for a preparatory process before image forming will be long, causing a delay in image forming. In this embodiment, however, concurrently performed cleaning of the transfer roller 30 and the cleaning roller 51 shortens the time required for a preparatory process before image forming and enables prompt image forming.

The power source 54 for applying the transfer bias to the transfer roller 30 includes the constant-current power source 58 for applying the first transfer bias, the constant-voltage power source 59 for applying the second transfer bias, and the selector switch 57. These power sources and the selector switch 57 are easy to structure because the first transfer bias or the second transfer bias is changed by the selector switch that switches between the constant-current power source 58 and the constant-voltage power source 59.

The first transfer bias is a constant-current bias outputted from the constant-current power source 58. Application of the constant-current bias to the transfer roller 30 regulates fluctuations in the amount of charge for the photosensitive drum 27, thereby stabilizing the surface potential of the photosensitive drum 27 that has contacted the transfer roller 30. When the surface potential of the photosensitive drum 27 is stable, the cleaning roller 51 is allowed to reliably collect and release toner from and to the photosensitive drum 27. As a result, the cleaning roller 51 is reliably cleaned.

If the first transfer bias is a constant-voltage bias, the resistance of the transfer roller 30 fluctuates, and the surface potential of the photosensitive drum 27 that has contacted the transfer roller 30 becomes unstable. This will disable the cleaning roller 51 to adequately collect and release toner from and to the photosensitive drum 27.

Because the transfer roller 30 is made of an ionic conduction type rubber material, the resistance of the transfer roller 30 is substantially uniform throughout the roller, although it varies greatly depending on environmental conditions. Accordingly, the surface potential of the photosensitive drum 27 that has contacted the transfer roller 30 is stabilized, and the cleaning roller 51 is allowed to collect and release toner in a stable manner.

The controller 56 is set to perform cleaning, such that the continuous application time of the first transfer bias and the continuous application time of the second transfer bias equal the time required for the transfer roller 30 to rotate once. In this embodiment, the diameter of the transfer roller 30 is greater than the diameter of the cleaning roller 51. Thus, the continuous application time of the first transfer bias and the continuous application time of the second transfer bias becomes longer than the time required for the cleaning roller 51 to rotate once.

In other words, the first transfer bias and the second transfer bias are continuously applied to the transfer roller 30 longer than the time from when a certain point of the cleaning roller 51 contacts the surface of the photosensitive drum 27 to when the certain point of the cleaning roller 51 contacts again the surface of the photosensitive drum 27.

Such control of the continuous application time of the first and second transfer biases allows the cleaning roller 51 to release all the collected toner to the surface of the photosensitive drum 27 and ensures a reliable cleaning of the cleaning roller 51.

In this embodiment, as described above, while the first cleaning bias is applied to the cleaning roller 51, the second transfer bias and the first transfer bias are applied in this order to the transfer roller 30, and the second transfer bias and the first transfer bias are applied again in this order to the transfer roller 30.

Because a cleaning cycle of the cleaning roller 51 and the transfer roller 30 is repeated twice, the cleaning roller 51 and the transfer roller 30 are reliably cleaned. Although the effect of cleaning is enhanced by performing two or more cleaning cycles, the time required for a preparatory process before image forming becomes longer as cleaning cycles are repeated. Thus, the number of cleaning cycles may be set arbitrarily by a user depending on the need for cleaning.

By performing cleaning of the transfer roller 30 and the cleaning roller 51 before image forming, toner remaining on the transfer roller 30 and the cleaning roller 51 are released to the photosensitive drum 27 before image forming. By the time image forming is started, the transfer roller 30 and the cleaning roller 51 are cleaned and ready for image forming.

As shown in FIG. 4, after cleaning is finished, image forming on a sheet 3 is started.

During image forming, the first transfer bias is applied to the transfer roller 30, and the developing bias is applied to the developing roller 31, with the main motor and the charger 29 ON.

While the first page (sheet 3) is passing between the photosensitive drum 27 and the transfer roller 30, the second cleaning bias is applied to the cleaning roller 51. The surface potential of the photosensitive drum 27 becomes the first surface potential (approximately 200–400V) due to the first transfer bias applied to the transfer roller 30.

The surface potential of the photosensitive drum 27 that is about to contact the cleaning roller 51 is the first surface potential (approximately 200–400 V), and the second cleaning bias (−200 V) is applied to the cleaning roller 51. Thus, when the photosensitive drum 27 contacts the cleaning roller 51, toner that has not been transferred to the first page (sheet 3) and remains on the photosensitive drum 27 is collected and temporarily held by the cleaning roller 51.

In other words, while a portion of the surface of the photosensitive drum 27 that has contacted the first page (sheet 3) is contacting the cleaning roller 51, toner remaining on the photosensitive drum 27 is collected by the cleaning roller 51.

When the second page (sheet 3) has not yet arrived between the photosensitive drum 27 and the transfer roller 30 after the first page (sheet 3) has passed therebetween, that is, while no sheet 3 is present between the photosensitive drum 27 and the transfer roller 30, the first cleaning bias is applied to the cleaning roller 51.

Because the first transfer bias is continuously applied to the transfer roller 30, the surface potential of the photosensitive drum 27 becomes the first surface potential (approximately 200–400 V) due to the first transfer bias applied to the transfer roller 30.

The surface potential of the photosensitive drum 27 that is about to contact the cleaning roller 51 is the first surface potential (approximately 200–400 V), and the first cleaning bias (600 V) is applied to the cleaning roller 51. Thus, toner that has been collected by the cleaning roller 51 during image forming on the first page (sheet 3) is released to the photosensitive drum 27.

In other words, while a portion of the surface of the photosensitive drum 27 that has not contacted any sheet 3 is contacting the cleaning roller 51, toner that has been held by the cleaning roller 51 is released to the surface of the photosensitive drum 27.

If a large amount of toner remains on the photosensitive drum 27 after toner has been transferred to the sheet 3, all the remaining toner could not be collected only by the developing roller 31. In this embodiment, however, the cleaning roller 51, besides the developing roller 31, removes the remaining toner from the photosensitive drum 27. Accordingly, the next toner image is formed on the photosensitive drum 27 without being affected by the remaining toner, and high image quality is maintained.

After image forming is completed on the last sheet 3, that is, on the second page in FIG. 4, the developing bias is stopped being applied to the developing roller 31, and the first cleaning bias (+600 V) is applied to the cleaning roller 51. At this time, because the charger 29 is kept ON and the first transfer bias is applied to the transfer roller 30, the surface potential of the photosensitive drum that is about to contact the cleaning roller 51 is approximately 200–400 V.

When the photosensitive drum 27 contacts the cleaning roller 51, toner that has remained on the photosensitive drum 27 without being transferred to the last sheet 3 and has been collected and held by the cleaning roller 51 is released to the photosensitive drum 27.

Thereafter, the cleaning bias and the first transfer bias are sequentially stopped being applied, and the main motor and the charger 29 are turned off.

In the above-described embodiment, when cleaning of the cleaning roller 51 is performed before image forming, the surface potential of the photosensitive drum 27 is changed between the first surface potential and the second surface potential by switching the transfer bias applied to the transfer roller 30 between the second transfer bias and the first transfer bias. However, another method may be used to change the surface potential of the photosensitive drum 27.

In the another method, the charger 29 is turned on first. The surface potential of the photosensitive drum 27 becomes 900 V, which is equal to the second surface potential. When the photosensitive drum 27 is irradiated with a laser beam emitted from the scanner unit 16, the surface potential of the irradiated portion of the photosensitive drum 27 becomes approximately 200 V, which is equal to the first surface potential.

The selector switch 57 is set to be in an electrically floating state without being connected to either the constant-voltage power source 59 or the constant-current power source 58. The selector switch 57 does not bear any fixed potential. In this case, when the photosensitive drum 27 contacts the transfer roller 30, the surface potential of the photosensitive drum 27 does not change.

Accordingly, by irradiating the photosensitive drum 27 with a laser beam, instead of applying the first transfer bias to the transfer roller 30 and by stopping irradiating the photosensitive drum 27 with a laser beam, instead of applying the second transfer bias to the transfer roller 30, cleaning of the cleaning roller 51 can be performed as effectively as in the above-described embodiment.

While the invention has been described in conjunction with a specific embodiment outlined above, it is evident that many alternatives, modifications and variations will be apparent to those skilled in the art. Accordingly, the preferred embodiment of the invention, as set forth above, is intended to be illustrative, not limiting. Various changes may be made without departing from the spirit and scope of the invention.

What is claimed is:

1. An image forming apparatus, comprising:

an image bearing member, a surface of which holds developing agent;

a cleaning member provided adjacent to the image bearing member, a surface of the cleaning member contacting the surface of the image bearing member; and a potential controller that keeps the surface of the cleaning member at a first cleaning potential, wherein the potential controller further switches a potential of the surface of the image bearing member between a first potential and a second potential, the first cleaning potential being lower than the second potential and higher than the first potential.

2. The image forming apparatus according to claim 1, wherein the developing agent is transferred from the surface of the image bearing member to the surface of the cleaning member when the surface of the image bearing member is at the second potential, and the developing agent is transferred from the surface of the cleaning member to the surface of the image bearing member when the surface of the image bearing member is at the first potential.

3. The image forming apparatus according to claim 2, further comprising:

a transfer member provided adjacent to the image bearing member, the potential controller selectively providing a first transfer bias or a second transfer bias to the transfer member, wherein the surface of the image bearing member is at the first potential when the potential controller provides the first transfer bias to the transfer member, and the surface of the image bearing member is at the second potential when the potential controller provides the second transfer bias to the transfer member.

4. The image forming apparatus according to claim 3, wherein a surface of the transfer member is disposed to contact the surface of the image bearing member, a surface potential of the transfer member provided with the first transfer bias is lower than the surface potential of the image bearing member that is about to contact the transfer member, and the surface potential of the transfer member provided with the second transfer bias is higher than the surface potential of the image bearing member that is about to contact the transfer member.

5. The image forming apparatus according to claim 3, wherein the potential controller comprises:

a first transfer power source that outputs the first transfer bias;

a second transfer power source that outputs the second transfer bias; and a switch that switches between outputs from the first transfer power source and from the second transfer power source.

6. The image forming apparatus according to claim 5, wherein the first transfer power source outputs the first transfer bias by constant-current control.

7. The image forming apparatus according to claim 5, wherein the second transfer power source outputs the second transfer bias by constant-voltage control.

8. The image forming apparatus according to claim 3, wherein the transfer member is a roller made of an elastic body of ionic conductive type.

9. The image forming apparatus according to claim 8, wherein the cleaning member is a roller made of an electrically conductive elastic body and has a smaller diameter than the roller as the transfer member.

10. The image forming apparatus according to claim 9, wherein the first transfer bias is continuously applied to the transfer member longer than a time required for the cleaning member to rotate once.

11. The image forming apparatus according to claim 9, wherein the second transfer bias is continuously applied to the transfer member longer than a time required for the cleaning member to rotate once.

12. The image forming apparatus according to claim 1, wherein the potential controller switches between the first potential and the second potential before image forming.

13. The image forming apparatus according to claim 12, wherein the potential controller switches between the first potential and the second potential a plurality of times.

14. The image forming apparatus according to claim 1, further comprising:

a developing member, a surface of which holds the developing agent and contacts the surface of the image bearing member, wherein the developing member collects the developing agent remaining on the surface of the image bearing member.

15. An image forming apparatus, comprising:

a photosensitive member;

a charger that uniformly charges a surface of the photosensitive member;

a laser irradiator that forms a latent image on the charged surface of the photosensitive member;

a developer that supplies toner to the latent image;

a transfer member that transfers the toner from the photosensitive member to a sheet;

a cleaning member that collects the toner remaining on the photosensitive member without being transferred from the photosensitive member to the sheet;

a first power source that selectively applies a first transfer bias and a second transfer bias to the transfer member, a second surface potential of the photosensitive member to which the second transfer bias is applied being higher than a first surface potential of the photosensitive member to which the first transfer bias is applied;

a second power source that selectively applies a first cleaning bias and a second cleaning bias to the cleaning member, the first cleaning bias being higher than the second cleaning bias;

a third power source that supplies a voltage to the charger; and a controller that controls the first, second, and third power sources, wherein the second cleaning bias is less than the first surface potential which is less than the first cleaning bias which is less than the second surface potential.

16. The image forming apparatus according to claim 15, wherein after the image forming apparatus is turned on and before image forming is started, the controller turns on the third power source to charge the photosensitive member, controls the second power source to apply the first cleaning bias to the cleaning member, and controls the first power source to apply the second transfer bias and the first transfer bias alternately to the transfer member, and wherein when the first power source applies the second transfer bias to the transfer member, toner remaining on the transfer member moves to the photosensitive member and is collected by the cleaning member, and when the first power source applies the first transfer bias to the transfer member, the toner collected by the cleaning member moves to the photosensitive member.

17. The image forming apparatus according to claim 15, wherein when the transfer member transfers the toner from the photosensitive member to the sheet, the controller turns on the third power source to charge the photosensitive member, controls the second power source to apply the second cleaning bias to the cleaning member, and controls the first power source to apply the first transfer bias to the transfer member, and wherein the cleaning member collects the toner that has been supplied to the latent image and remains on the photosensitive member without being transferred to the sheet.

18. The image forming apparatus according to claim 17, wherein during an interval between completion of image forming on a sheet and a start of image forming on a next sheet, the controller keeps the third power source on, controls the second power source to apply the first cleaning bias to the cleaning member, and controls the first power source to apply the first transfer bias to the transfer member, and wherein the cleaning member releases the collected toner to the photosensitive drum.

19. A method for removing developing agent from an image bearing member and a cleaning member provided adjacent to the image bearing member with a surface of the cleaning member contacting a surface of the image bearing member, comprising:

maintaining a first cleaning potential to the surface of the cleaning member; and switching a potential of the surface of the image bearing member between a first potential and a second potential wherein the first cleaning potential is lower than the second potential and higher than a first potential.

20. The method of claim 19, wherein after an image forming apparatus is turned on and before image forming has started, the potential of the surface of the cleaning member is maintained at the first cleaning potential and the potential of the surface of the image bearing member is switched between the first potential and the second potential wherein when the second potential is applied, toner remaining on the image forming member is collected by the cleaning member and when the first potential is applied, the toner collected by the cleaning member moves to the image forming member.

21. The method of claim 19, wherein during an interval between completion of image forming on a sheet and a start of image forming on a next sheet, the potential of the surface of the cleaning member is maintained at the first cleaning potential and the potential of the surface of the image bearing member is switched to the first potential such that the cleaning member releases collected developing agent to the image bearing member.

* * * * *